US006896128B1

(12) United States Patent
Johnson

(10) Patent No.: US 6,896,128 B1
(45) **Date of Patent: *May 24, 2005**

(54) AUTOMATED TIGHTENING SHOE

(76) Inventor: Gregory G. Johnson, 3417 Longfellow Ave. South, Minneapolis, MN (US) 55407

( * ) Notice: Subject to any disclaimer, the term of this patent is extended or adjusted under 35 U.S.C. 154(b) by 0 days.

This patent is subject to a terminal disclaimer.

(21) Appl. No.: 10/093,918

(22) Filed: Mar. 7, 2002

Related U.S. Application Data

(60) Division of application No. 09/675,607, filed on Sep. 29, 2000, now Pat. No. 6,467,194, which is a continuation-in-part of application No. 09/048,772, filed on Mar. 26, 1998, now abandoned.

(51) Int. Cl.[7] ..... A43C 11/00; A43B 5/04
(52) U.S. Cl. ..... 206/50.1; 36/118.1

(58) Field of Search ..... 36/50.1, 50.5, 36/118.1, 118.2, 138; 24/712.7

(56) References Cited

U.S. PATENT DOCUMENTS 4,724,626 A 2/1988 Baggio
5,205,055 A 4/1993 Harrell
6,467,194 B1 * 10/2002 Johnson ..... 36/50.1

* cited by examiner

*Primary Examiner*—Jila M. Mohandesi
(74) *Attorney, Agent, or Firm*—Hugh D. Jaeger

(57) ABSTRACT

An automated tightening shoe with crisscrossed laces and a tightening mechanism which operates in one direction to cause automatic tightening of the crisscrossed laces to tighten the shoe about a wearer's foot, and which can be released easily so that the shoe can be removed from the wearer's foot.

20 Claims, 9 Drawing Sheets

AUTOMATED TIGHTENING SHOE

CROSS REFERENCES TO CO-PENDING APPLICATIONS

This patent application is a division of Ser. No. 09/675,607 entitled "Automated Tightening Shoe" filed on Sep. 29, 2000, now U.S. Pat. No. 6,467,194, which is a continuation-in-part of Ser. No. 09/048,772 entitled "Automatic Tightening Shoe" filed on Mar. 26, 1998, abandoned.

BACKGROUND OF THE INVENTION

1. Field of the Invention

The present invention pertains to a shoe and, more particularly, to an automated tightening shoe. The shoe is provided with an automated tightening system including a tightening mechanism which operates in one direction to cause automatic tightening of the shoe about a wearer's foot, and which can be released easily so that the shoe can be readily removed from the wearer's foot. The invention is chiefly concerned with an automated tightening shoe of the sport or athletic shoe variety, but the principles of the invention are applicable to shoes of many other types and styles.

2. Description of the Prior Art

Shoes which incorporate an automated tightening system are known in the prior art. However, none of the automated tightening systems heretofore devised has been entirely successful or satisfactory. Major shortcomings of the automated tightening systems of the prior art are that they fail to tighten the shoe from both sides so that it conforms snugly to the wearer's foot, and that they lack any provision for quickly loosening the shoe when it is desired to remove the shoe from the wearer's foot. Aspects of prior art automated tightening systems contributing to their lack of success and satisfaction have been (1) complexity, in that they involve numerous parts; (2) the inclusion of expensive parts, such as small electric motors; (3) the use of parts needing periodic replacement, e.g. a battery; and (4) the presence of parts requiring frequent maintenance. These aspects, as well as others not specifically mentioned, indicate that considerable improvement is needed in order to attain an automated tightening shoe that is completely successful and satisfactory.

SUMMARY OF THE INVENTION

The general purpose of the present invention is to provide an automated tightening shoe that is devoid of the various shortcomings and drawbacks characteristic of shoes of this sort which exist in the prior art.

Accordingly, the primary objective of the present invention is to produce an automated tightening shoe, especially a sport or athletic shoe, that tightens snugly about the wearer's foot from both sides and that can be loosened easily. It is a further objective of the present invention to attain the primary objective by providing an automated tightening system which requires no complex or expensive parts, and which includes no parts that need frequent maintenance or periodic replacement. Another objective of the present invention is to provide an automated tightening shoe which is easy to operate and trouble-free in use.

The foregoing general purpose and objectives of the present invention are fully achieved by the automated tightening shoe of the present invention. As stated previously, the principles of the invention are applicable to shoes of many types and styles, but are especially applicable to shoes of the sport or athletic variety. Accordingly, it is this sort of shoe which has been selected for illustrating the principles of the invention.

The automated tightening shoe of the invention includes a sole and an integral body member or shoe upper constructed of any common sport or athletic shoe material or materials connected to the sole. The integral body member or shoe upper includes a toe, a heel, a tongue, a gap above the tongue, and a reinforced lacing pad straddling the tongue, the reinforced lacing pad having a number of pairs of lace eyelets provided around the periphery of the gap. The shoe also includes a chamber in the sole adjacent to the heel and a passageway in the heel which communicates with the chamber in the sole and extends from the chamber upwardly along the heel to near the top of the heel. A pair of laces for tightening the shoe at the gap are provided. Each lace has one and anchored to a respective lace eyelet nearest to the toe of the shoe by an anchor button, extends through alternate ones of the lace eyelets in crisscross fashion over the tongue, and then passes through the material of the shoe upper to within the chamber in the sole whereat it is operatively associated with a tightening mechanism. The tightening mechanism can be one of several different forms.

Each of the tightening mechanism forms includes an engagement lace which resides partly within the chamber in the sole and partly within the passageway in the heel. The engagement lace is movable in a tightening direction along the chamber in the sole and along the passageway in the heel. In the first form, the tightening mechanism includes, in addition to the engagement lace, two pairs of spring-loaded gripping cams housed within the chamber in the sole. The two pairs of spring-loaded gripping cams are located on opposite sides of the chamber in the sole and lie in a common plane parallel to the sole. Each of the laces passes between a respective pair of the spring-loaded gripping cams. After passing between the respective pairs of spring-loaded gripping cams, the laces are joined to each other and to one end of the engagement lace. The other end of the engagement lace extends out of the passageway in the heel and includes a pulling loop for grasping in order to move the engagement lace in the tightening direction. By pulling the loop, the laces are caused to tighten about the tongue and thereby tighten the shoe. The spring loaded gripping cams allow movement of the laces therebetween during tightening and prevent reverse movement of the laces after tightening is completed. Further provided is a recoil spring located within the chamber in the sole. The recoil spring has a first end connected to the engagement lace and a second end connected to a wall surface within the chamber in the sole. The recoil spring operates to draw the engagement lace back into the chamber in the sole after tightening is completed. A release lace connected to the spring-loaded gripping cams and to a release lever protruding outwardly from the passageway in the heel enables disengagement of the spring-loaded gripping cams from the laces to allow free reverse movement of the laces when it is desired to loosen the shoe to remove it from the wearer's foot.

A second form of tightening mechanism is identical in all respects to the first form except for the positioning of the two pairs of spring-loaded gripping cams. In the second form, instead of the two pairs of spring-loaded gripping cams being located on opposite sides of the chamber in the sole in a common plane parallel to the sole, the two pairs of spring-loaded gripping cams are located one above the other in vertical alignment centrally of the chamber in the sole and are separated by a separation plate.

A third form of tightening mechanism involves, in addition to the engagement lace, a track extending vertically along the rear of the heel and a slide frictionally engaged in the track. The engagement lace is coupled to the slide within the passageway in the heel and is movable both upwardly and downwardly within the passageway in the heel by corresponding movement of the slide.

A fourth form of tightening mechanism involves, in addition to the engagement lace, an axle located within the chamber in the sole upon which a ratchet wheel with ratchet teeth is mounted. A pawl engageable with the ratchet teeth is affixed to the heel and is connected to a release lever which protrudes from the rear of the heel. The laces after entering the chamber in the sole are coiled in the same direction about opposite ends of the axle, and the engagement lace is coiled about the axle at a location approximately midway between the coiled laces but in a direction which is opposite to the direction in which the laces are coiled. The engagement lace has an end extending out of the passageway in the heel and includes a pulling loop for grasping to move it in the tightening direction. When the engagement lace is pulled by the pulling loop, the laces further coil about the axle and thereby the shoe is tightened. The pawl successively engages the ratchet teeth of the ratchet wheel to prevent reverse movement.

Although all of the aspects and features of the automated tightening shoe enumerated above are important to the attainment of the purpose and objectives of the present invention and contribute to the overall superior quality, easy operation, and trouble-free performance of the shoe, certain ones are especially significant and merit special recognition.

One such significant aspect and feature of the present invention is the arrangement of crisscrossed laces which effects tightening of the automated tightening shoe from both sides, thus producing a snug fit about the wearer's foot.

Another such significant aspect and feature of the present invention is an engagement lace which is coupled to the laces and is movable in a tightening direction to tighten the laces.

Still another such significant aspect and feature of the present invention is a pair of spring-loaded gripping cams which allow movement of the laces during tightening and grip the laces to prevent reverse movement of the laces after tightening is completed.

Yet another such significant aspect and feature of the present invention is a release lace and release lever for disengaging the spring-loaded gripping cams from the laces to allow free reverse movement of the laces to enable loosening of the shoe for removal from the wearer's foot.

A still further such significant aspect and feature of the present invention is a recoil spring for drawing the engagement lace back in the reverse direction after tightening is completed.

Yet a further such significant aspect and feature of the present invention is a tightening mechanism which includes a track and slide.

Another significant aspect and feature of the present invention is a tightening mechanism which includes a ratchet wheel mounted on an axle, the ratchet wheel including ratchet teeth engageable by a pawl.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
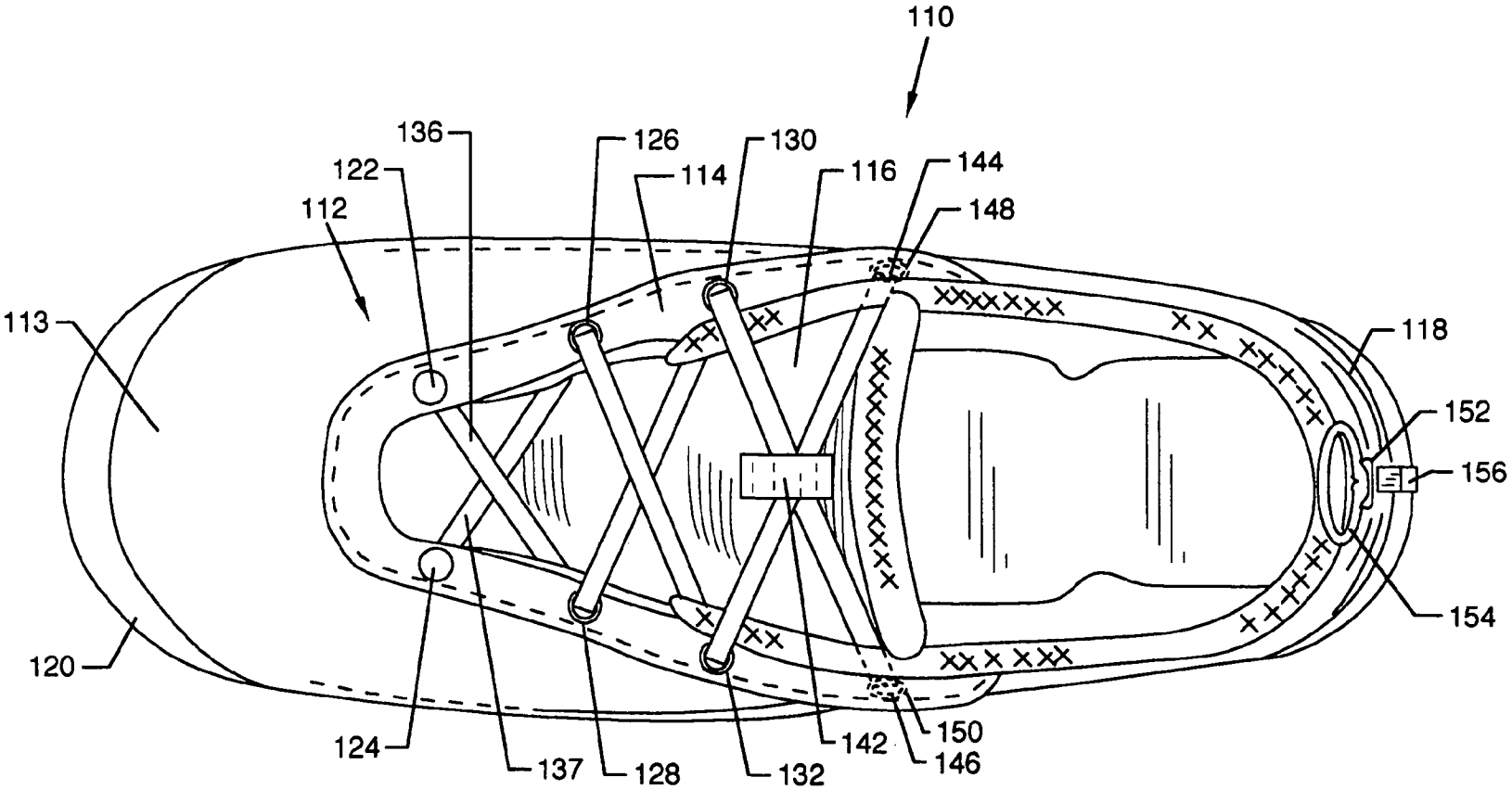
FIG. 1 illustrates a top view of an automated tightening shoe, the present invention, in the open condition.
Figure 2:
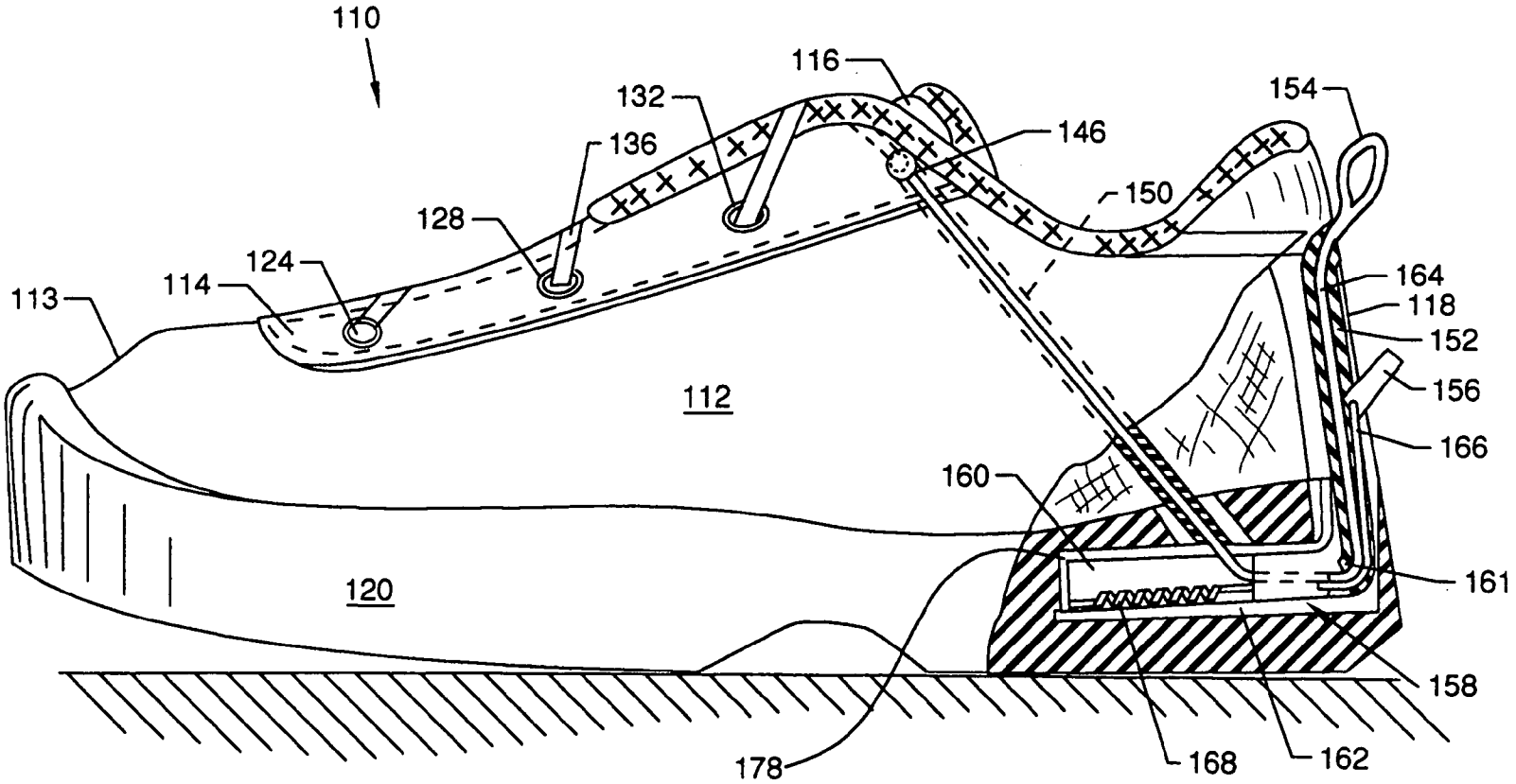
FIG. 2 illustrates a side view, in partial cutaway, of the automated tightening shoe with a first form of tightening mechanism.

FIG. 1 illustrates a top view of an automated tightening shoe 110, the present invention, in the open condition, and FIG. 2 illustrates a side view, in partial cutaway, of the automated tightening shoe 110 with a first form of tightening mechanism.

The automated tightening shoe 110, as illustrated, is a sport or athletic shoe having a sole 120, an integral body member or shoe upper 112 including a tongue 116, a toe 113, a heel 118, and a reinforced lacing pad 114, all constructed of any common sport or athletic shoe materials. At the toe 113 end of tongue 116 there are provided two anchor buttons 122 and 124 which are secured to shoe laces 136 and 137, respectively, at one end. The shoe laces 136 and 137 then crisscross over tongue 116 and pass through lace eyelets 126, 128, 130 and 132, as illustrated, before passing through lace containment loop 142. After passing through lace containment loop 142, lace 136 passes through a hole 146 in the reinforced lacing pad 114 and travels downwardly and rearwardly through a section of tubing 150 which passes in-between the outer and inner materials of the shoe upper 112, and lace 137 passes through a hole 144 in the reinforced lacing pad 114 and travels downwardly and rearwardly through a section of tubing 148 which also passes in-between the outer and inner materials of the shoe upper 112, as illustrated. The lower ends of tubing 148 and tubing 150 enter a chamber 160 in the sole 120 of the automated tightening shoe 110 where shoe laces 136 and 137 leave tubings 148 and 150 and pass through a first form of tightening mechanism 158 which is secured to a mechanism base 162 which in turn is secured to the interior of sole 120 inside chamber 160. There is also provided a housing plate 178 which covers the tightening mechanism 158 and which, in conjunction with mechanism base 162, encases the tightening mechanism 158.

After passing through the tightening mechanism 158, shoe laces 136 and 137 intersect and mutually secure to an engagement lace 164. Engagement lace 164 then passes through a section of tubing 152 which passes upwardly within a passageway 161 in the heel 118. The engagement lace 164 then passes out of tubing 152 and passageway 161 and terminates in a pulling loop 154. There is also provided a release lace 166 which is secured to the tightening mechanism 158 and passes upwardly through tubing 152 to about midway of tubing 152 where a release lever 156 enters tubing 152. Release lace 166 passes through release lever 156 and passes downwardly through tubing 152 and is secured to the tightening mechanism 158. The release lace 166 is taut at all times when the release lace 166 is properly secured. The release lever 156 acts as a toggle switch which disengages the tightening mechanism 158 when pressed downwardly. There is also provided a recoil spring 168 within chamber 160 which pulls the engagement lace 164 back into chamber 160 after engagement. The first form of tightening mechanism 158 and its mode of operation will be more easily understood and further described with reference to FIG. 3.

Figure 3:
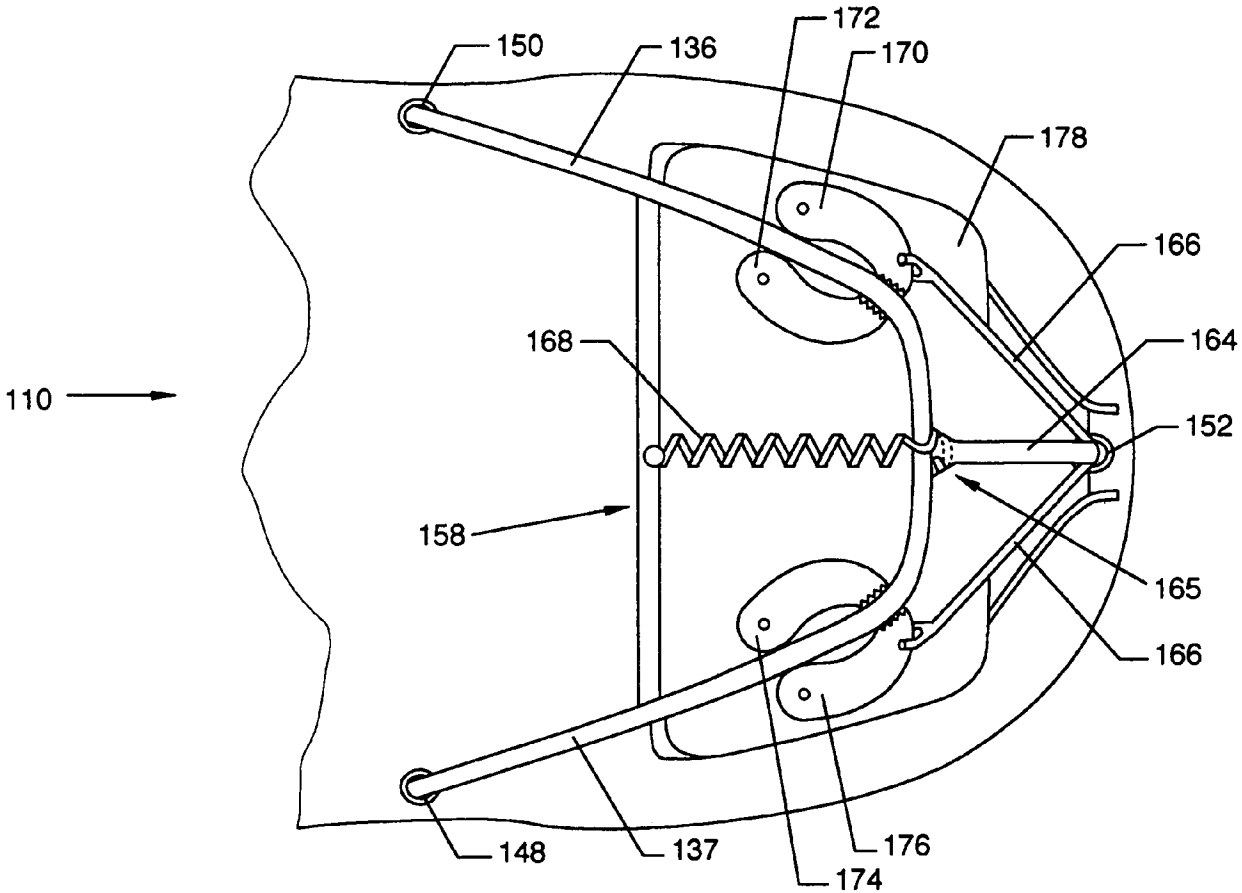
FIG. 3 illustrates a bottom view of the automated tightening shoe with the sole and mechanism base removed to reveal details of the first form of tightening mechanism.

FIG. 3 illustrates a bottom view of the automated tightening shoe 110 with the sole 120 and mechanism base 162 removed for purposes of illustrative clarity to reveal details of the tightening mechanism 158, where all numerals which have appeared previously correspond to those elements previously described. Illustrated in particular is the tightening mechanism 158 and the orientation of its component parts. The tubings 148 and 150 guide the shoe laces 137 and 136, respectively, into the chamber 160 of sole 120. Then shoe lace 136 is guided between a pair of spring-loaded gripping cams 170 and 172, and shoe lace 137 is guided between a pair of spring-loaded gripping cams 174. Then both shoe laces 136 and 137 intersect and mutually secure to engagement lace 164 at an intersection point 165 located within chamber 160. Engagement lace 164 then passes upwardly through tubing 152 in passageway 161 to meet pulling loop 154. When pulling loop 154 is pulled upwardly until the shoe laces 136 and 137 tighten, the automated tightening shoe 110 snugly fits the wearer's foot. The spring-loaded gripping cams 170, 172, 174 and 176 then prevent the laces 136 and 137 from reverse travel. The spring 168 then pulls the slack out of engagement lace 164 and pulls the excess lacing back into chamber 160.

In order to remove the automated tightening shoe 110, release lever 156 is pushed downwardly causing release lace 166 to pull spring-loaded gripping cams 170 and 176 simultaneously away from laces 136 and 137, creating free movement. This free movement allows the user to easily remove the automated tightening shoe 110.

Figure 4:
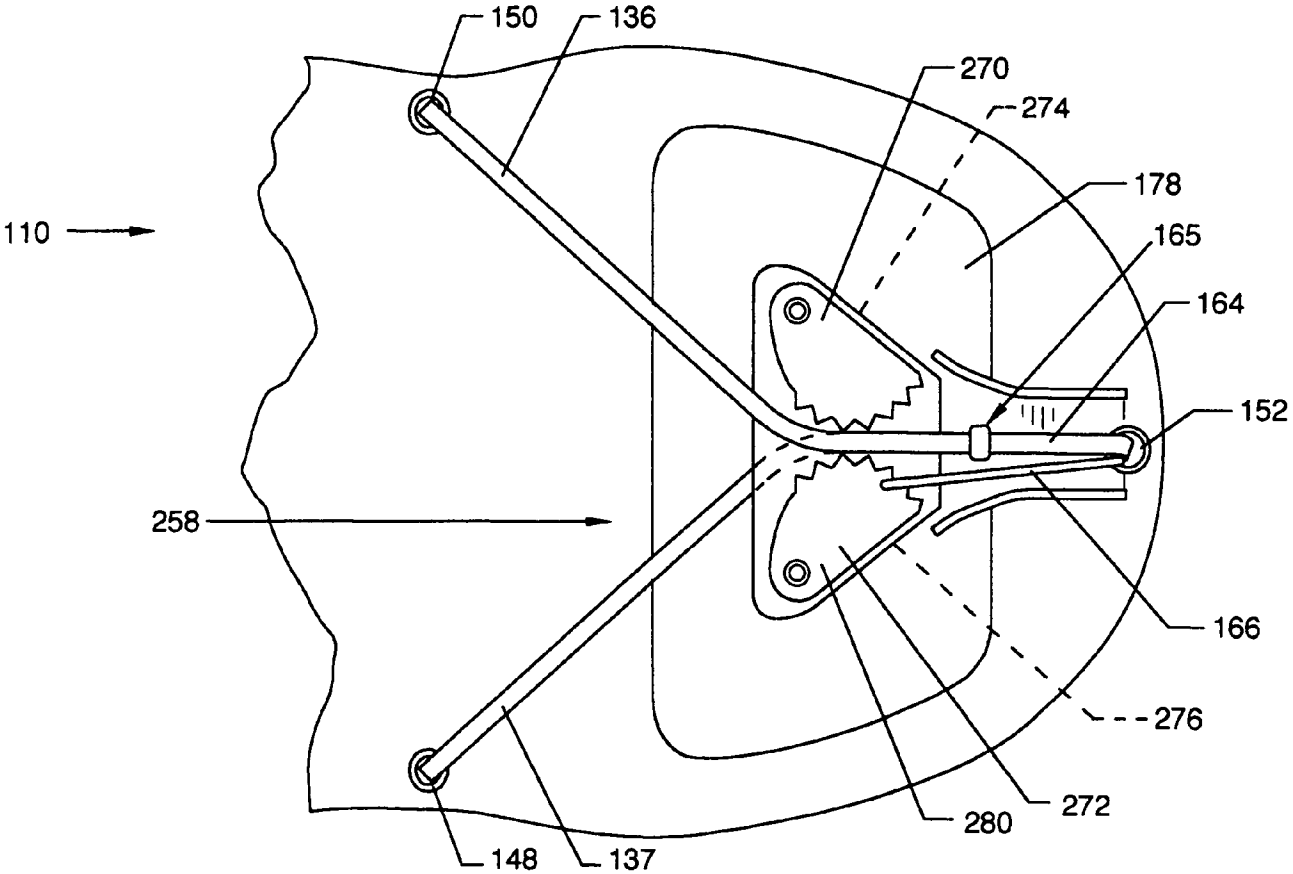
FIG. 4 illustrates a bottom view of the automated tightening shoe with the sole and mechanism base removed to reveal details of a second form of tightening mechanism.
Figure 5:
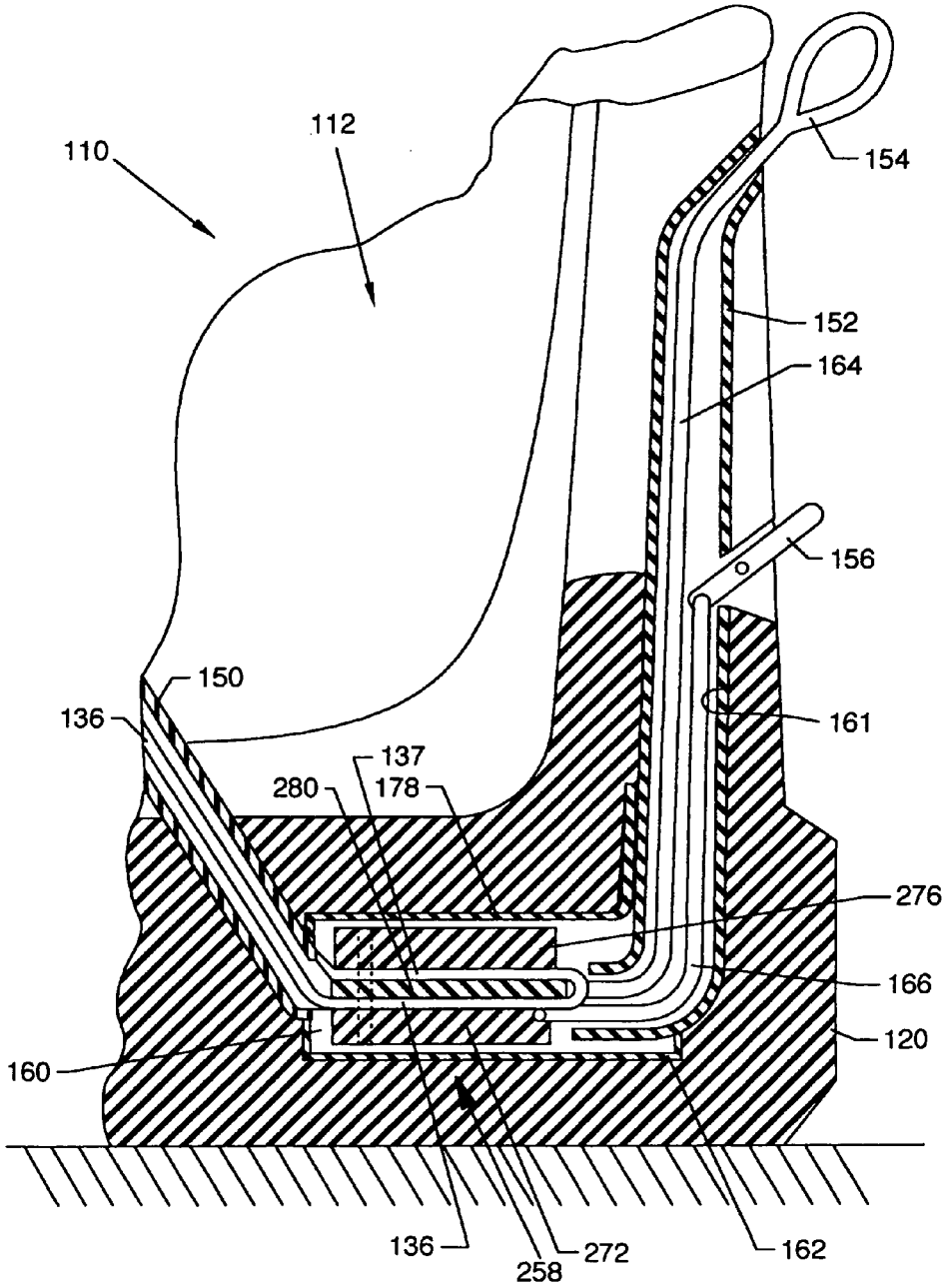
FIG. 5 illustrates a cross sectional view of the posterior portion of the automated tightening shoe provided with the second form of tightening mechanism.

FIG. 4 illustrates a bottom view of the automated tightening shoe 110 with the sole 120 and mechanism base 162 removed for purposes of illustrative clarity to reveal a second form of tightening mechanism 258, and FIG. 5 illustrates a cross sectional view of the posterior portion of the automated tightening shoe 110 provided with the second form of tightening mechanism 258, where all numerals which have been mentioned before correspond to those elements previously described. These figures illustrate an alternative configuration of the components described in FIGS. 2 and 3. The second form of tightening mechanism 258 functions and is constructed in a similar fashion to the first form of tightening mechanism 158 having two pairs of spring-loaded gripping cams 270 and 272, and 274 and 276, vertically aligned and separated by a separation plate 280. Shoe lace 136 passes between spring-loaded gripping cams 270 and 272, and shoe lace 137 passes through spring-loaded gripping cams 274 and 276. Separation plate 280 prevents shoe laces 136 and 137 from entanglement and allows the two pairs of spring-loaded gripping cams 270 and 272, and 274 and 276, to be vertically aligned to function without interfering with one another. After the shoe laces 136 and 137 pass through the pairs of spring-loaded gripping cams 270 and 272, and 274 and 276, they intersect and mutually secure to engagement lace 164. This second form of tightening mechanism functions in a similar fashion to the first form of tightening mechanism, only the configuration of the components is changed.

Figure 6:
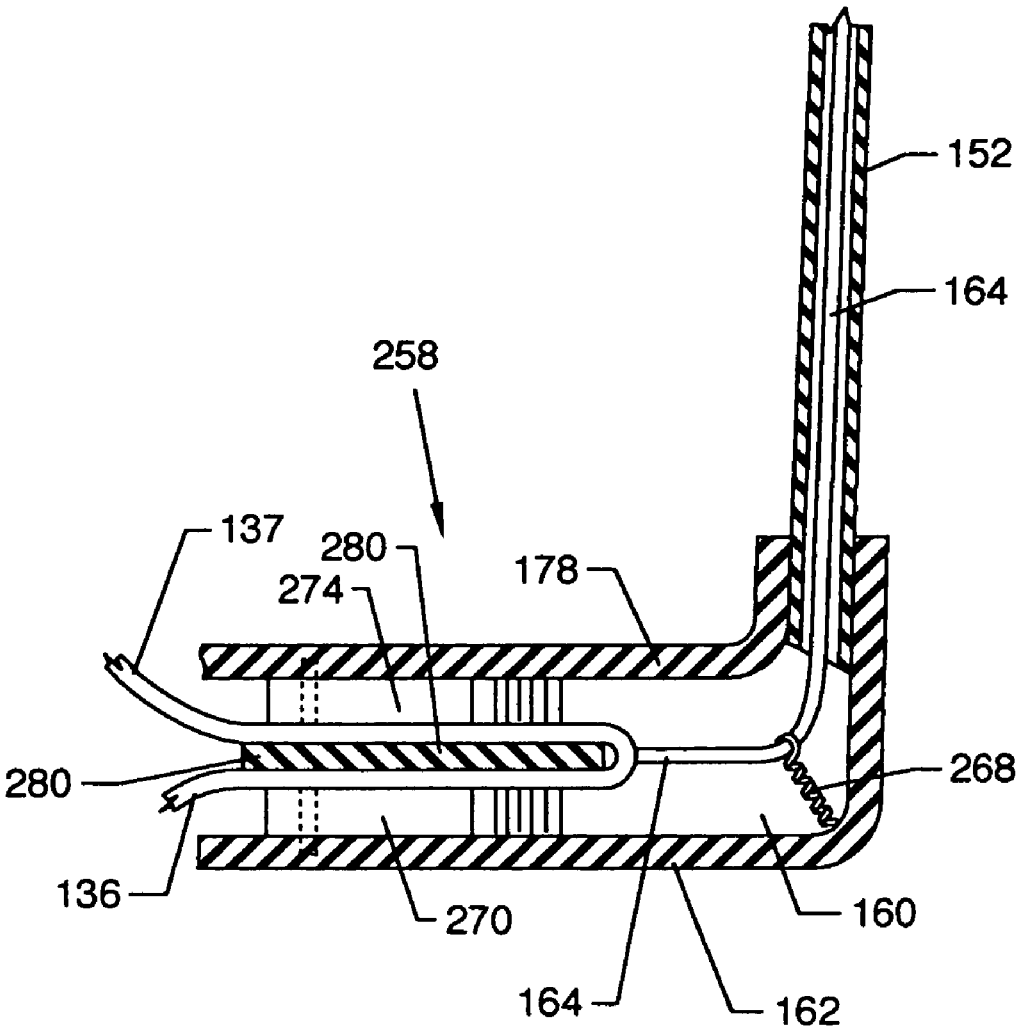
FIG. 6 illustrates a cross sectional view the second form of tightening mechanism.

FIG. 6 illustrates a cross sectional view of the tightening mechanism 258, where all numerals which have appeared previously correspond to those elements previously described. Illustrated in particular is the recoil spring 268 which is secured at one end to mechanism base 162 and is secured over and about engagement lace 164 at the opposite end. Once the pulling loop 154 (FIG. 5) is pulled to the desired tightness, this recoil spring 268 then pulls the slack out of engagement lace 164, and pulls the excess lacing back into chamber 160, causing pulling loop 154 to return to its original position. Also illustrated is the orientation of the mechanism base 162 in relation to the housing plate 178.

Figure 7:
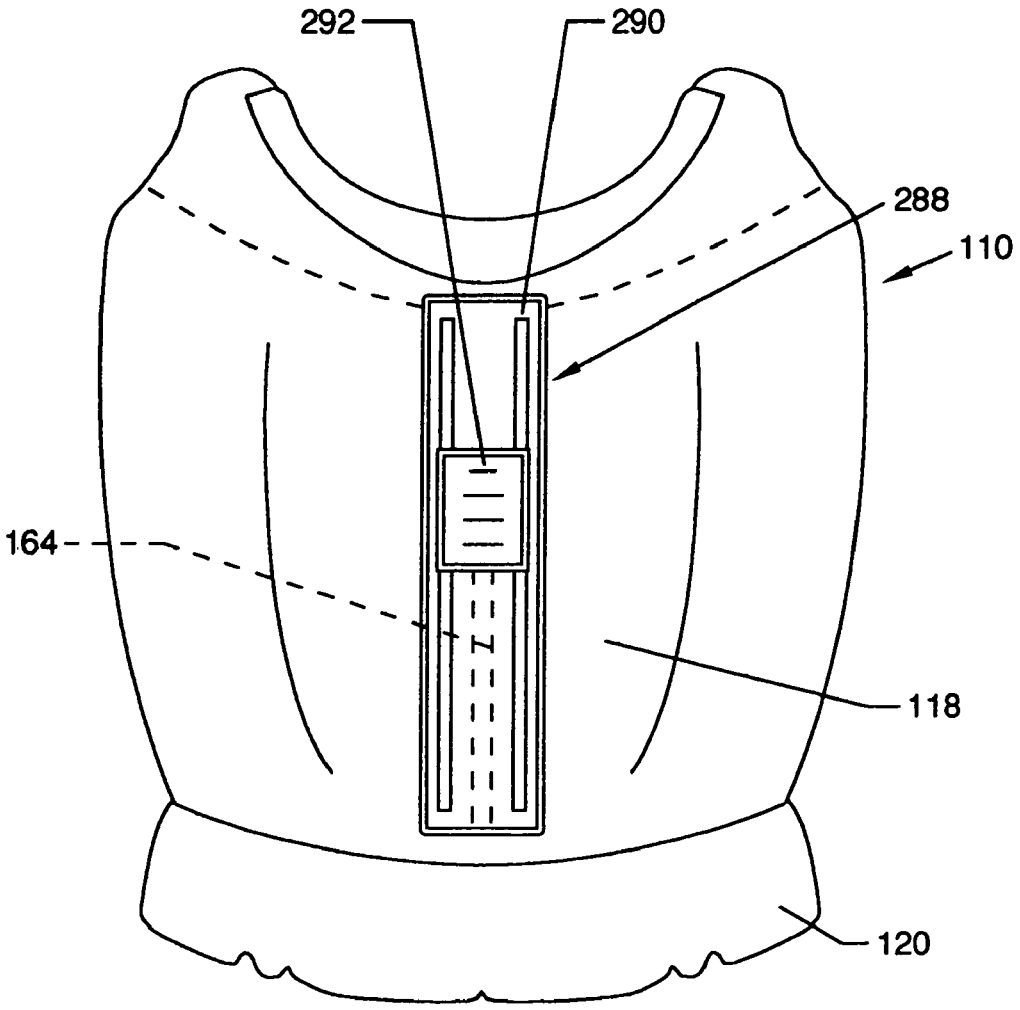
FIG. 7 illustrates a rear view of the automated tightening shoe incorporating a track and slide mechanism, a third form of tightening mechanism.

FIG. 7 illustrates a rear view of the automated tightening shoe 110 incorporating a track and slide mechanism 288, a third form of tightening mechanism, where all numerals which have appeared previously correspond to those elements previously described. With additional reference to FIG. 5, the track and slide mechanism 288 can be substituted for the pulling loop 154 and release lever 156. The track and slide mechanism incorporates a track 290 which is frictionally engaged by a slide 292 that travels vertically along the length of track 290. By moving the slide 292 upwardly along track 290, the engagement lace 164 is actuated, causing the automated tightening shoe 110 to tighten. Conversely, by moving the slide 292 downwardly along track 290, the engagement lace 164 is released, thereby enabling the automated tightening shoe 110 to be loosened.

Figure 8:
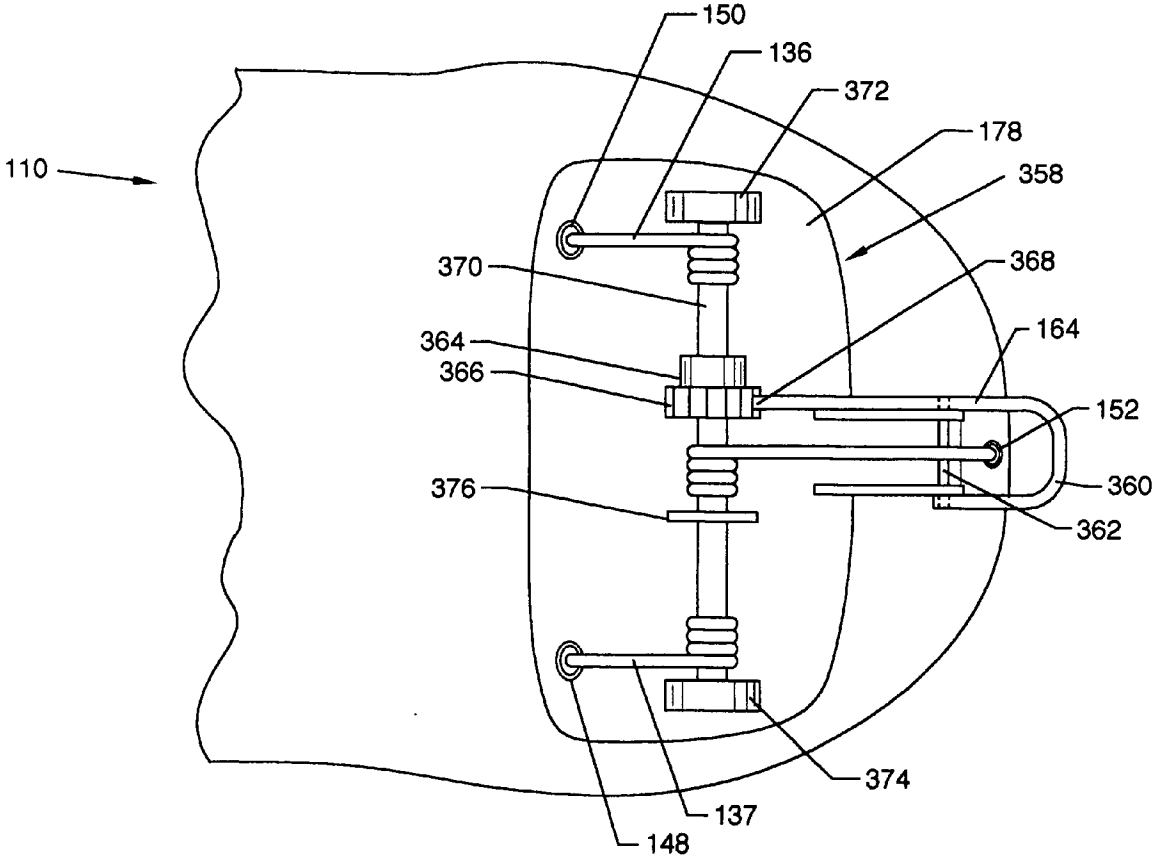
FIG. 8 illustrates a bottom view of the automated tightening shoe with the sole and mechanism base removed to reveal details of a fourth form of tightening mechanism; and, FIG. 9 illustrates a partial cross sectional view of the fourth form of tightening mechanism.
Figure 9:
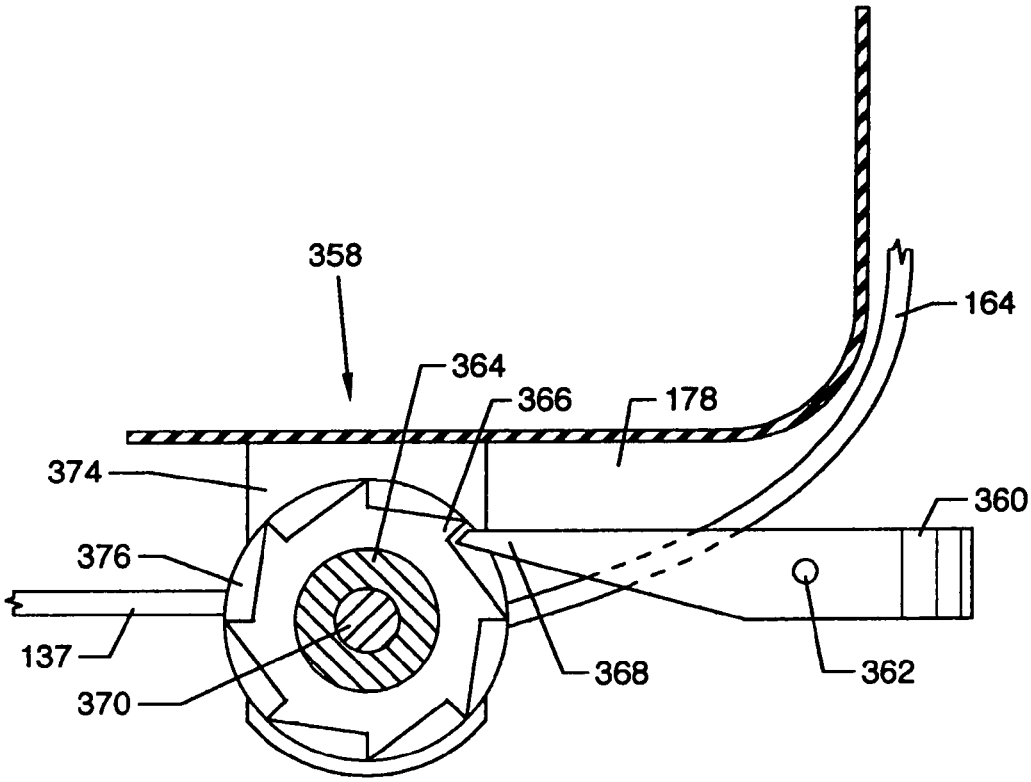

FIG. 8 illustrates a bottom view of the automated tightening shoe 110 with the sole 120 and mechanism base 162 removed for purposes of illustrative clarity to reveal a fourth form of tightening mechanism 358, and FIG. 9 illustrates a partial cross sectional view the tightening mechanism 358, where all numerals which have appeared previously correspond to those elements previously described. The tightening mechanism 358 can be substituted for the tightening mechanisms 158, 258 and 288 of the previous embodiments without affecting the function or scope thereof. Tightening mechanism 358 is comprised of a housing plate 178 to which is secured a pair of axle support members 372 and 374 which extend downwardly in a perpendicular fashion and accommodate a ratchet wheel axle 370. There is a ratchet wheel 364 with ratchet teeth 366 which is secured over and about ratchet wheel axle 370 midway between axle support members 372 and 374. A release lever 360 is pivotally secured to housing plate 178 at its posterior by a release lever axle 362. The inward end of release lever 360 incorporates a release lever pawl 368 which successively engages the ratchet teeth 366, as illustrated. Shoe laces 136 and 137 coil over and about ratchet wheel axle 370 and are appropriately secured thereto. Engagement lace 164 also coils over and about ratchet wheel axle 370 but in the opposite direction, and is secured thereto. When the engagement lace 164 is pulled, the ratchet wheel axle 370 and the ratchet wheel 364 rotate in a counterclockwise fashion, further coiling shoe laces 136 and 137, which tightens the automated tightening shoe 110.

The tension created at engagement causes the release lever pawl 368 to ratchetingly engage ratchet teeth 366, preventing slippage during engagement. Once release lever 360 is engaged, release lever pawl 368 disengages ratchet tooth 366 and the ratchet wheel axle 370 and the ratchet wheel 364 travel in a clockwise fashion uncoiling shoe laces 136 and 137 and releasing the lace tension in the automated tightening shoe 110. There is also provided a containment washer 376 which prevents shoe lace 137 from entangling with engagement lace 164. The ratchet wheel 364 acts as a containment device which prevents lace 136 from entangling with the engagement lace 164. The slack created in engagement lace 164 at engagement is pulled back into the shoe, as previously described, or a clutch mechanism, like that used in lawnmower pull cords, can be incorporated to accomplish the same results.

Various modifications can be made to the present invention without departing from the apparent scope hereof.

It is claimed:

1. An automated tightening shoe comprising:

a sole;

an upper connected to the sole, the upper including a toe, and a heel;

a tightening mechanism secured inside the sole of the shoe, the tightening mechanism including an engagement lace having a first end secured to the tightening mechanism and a second end disposed outside the tightening mechanism and external to the shoe, the engagement lace being moveable in a tightening direction;

at least one lace secured at one end to the upper and secured at another end to the tightening mechanism;

wherein movement of the engagement lace in the tightening direction causes the at least one lace to tighten the shoe.

2. An automated tightening shoe comprising:

a sole;

an upper connected to the sole, the upper including a toe, and a heel;

a tightening mechanism secured to the shoe, the tightening mechanism including an engagement lace having a first end secured to the tightening mechanism and a second end disposed outside the tightening mechanism and external to the shoe, the engagement lace being moveable in a tightening direction;

at least one lace secured at one end to the upper and secured at another end to the tightening mechanism, wherein the at least one lace runs down a side of the upper;

wherein movement of the engagement lace in the tightening direction causes the at least one lace to tighten the shoe.

3. An automated tightening shoe comprising:

a sole;

an upper connected to the sole, the upper including a toe, a heel, and a tongue;

a tightening mechanism secured to the shoe, the tightening mechanism including an engagement lace having a first end secured to the tightening mechanism and a second end disposed outside the tightening mechanism and external to the shoe, the engagement lace being moveable in a tightening direction;

at least one lace secured to the upper and further secured to the tightening mechanism;

wherein movement of the engagement lace in the tightening direction causes the at least one lace to tighten about the tongue and thereby tighten the shoe.

4. The automated tightening shoe of claim 3, the shoe including lacing eyelets spaced along opposite sides of the tongue of the upper, the at least one lace passing through the lacing eyelets.

5. The automated tightening shoe of claim 3, wherein the sole includes a chamber, the tightening mechanism being disposed in the chamber.

6. The automated tightening shoe of claim 5, wherein the chamber is located adjacent to the heel.

7. The automated tightening shoe of claim 3, further comprising a release mechanism.

8. The automated tightening shoe of claim 7, wherein the release mechanism comprises a lever.

9. The automated tightening shoe of claim 3, wherein a first lace is secured to the upper at one end of the first lace and is secured at another end of the first lace to the tightening mechanism and a second lace is secured to the upper at one end of the second lace and is secured at another end of the second lace to the tightening mechanism.

10. The automated tightening shoe of claim 3, wherein the second end of the engagement lace includes a pulling loop.

11. The automated tightening shoe of claim 3, wherein the at least one lace secured to the upper runs down a side of the upper before securing to the tightening mechanism.

12. The automated tightening shoe of claim 9, wherein the first lace runs down a first side of the upper before securing to the tightening mechanism and the second lace runs down a second side of the upper before securing to the tightening mechanism.

13. A method of automatically tightening a shoe around a foot of a wearer comprising the steps of:

providing a shoe including a tightening mechanism, the tightening mechanism including an engagement lace having a first end secured to the tightening mechanism and a second end disposed external to the shoe, the engagement lace being moveable in a tightening direction, the shoe further including at least one lace further secured to the shoe and the tightening mechanism;

inserting a foot of the wearer into the shoe; and pulling the engagement lace in the tightening direction so as to tighten the shoe around the wearer's foot.

14. The method of claim 13, further comprising the step of releasing the tightening mechanism.

15. The method of claim 14, wherein the tightening mechanism is released by the foot of the wearer.

16. The method of claim 14, wherein the tightening mechanism is released by the hand of the wearer.

17. The method of claim 14, wherein the step of releasing the tightening mechanism comprises the step of engaging a release lever.

18. The method of claim 17, wherein the release lever is engaged by the foot of the wearer.

19. The method of claim 17, wherein the release lever is engaged by the hand of the wearer.

20. The method of claim 13, further comprising the step of removing the foot from the shoe.

* * * * *